United States Patent [19]

Leibinger et al.

[11] Patent Number: 4,523,176

[45] Date of Patent: Jun. 11, 1985

[54] ELECTRICAL SWITCH

[75] Inventors: Paul Leibinger, Rietheim-Weilheim; Alfons Steidle, Spaichingen, both of Fed. Rep. of Germany

[73] Assignee: Firma Marquardt GmbH, Rietheim-Weilheim, Fed. Rep. of Germany

[21] Appl. No.: 381,759

[22] Filed: May 25, 1982

[30] Foreign Application Priority Data

May 27, 1981 [DE] Fed. Rep. of Germany ..... 3121033

[51] Int. Cl.[3] ..... H01C 10/36

[52] U.S. Cl. ..... 338/179; 200/159 A; 338/198; 338/200

[58] Field of Search ..... 338/172, 179, 198, 200, 338/201, 199, 202, 164, 184, 176, 179, 180, 181, 183; 200/16 B, 159 A, 159 R, 257, 328, 340; 361/413

[56] References Cited

U.S. PATENT DOCUMENTS

| | | | |
|---|---|---|---|
| 2,650,270 | 8/1953 | Mucher | 338/172 X |
| 3,124,780 | 3/1964 | Hulbert | 338/184 X |
| 3,585,563 | 6/1971 | Hegle | 338/183 X |
| 3,622,934 | 11/1971 | Yano et al. | 338/179 X |
| 4,225,845 | 9/1980 | Ragan | 338/202 X |
| 4,251,796 | 2/1981 | Soeda et al. | 338/176 |
| 4,284,969 | 8/1981 | Carbonneau | 338/176 X |

*Primary Examiner*—C. L. Albritton

[57] ABSTRACT

An electrical switch comprises, in addition to its switching mechanism or mechanisms, a potentiometer including a potentiometer plate and a slider which is advantageously moved/simultaneously with the actuation of the switching mechanisms. The switch requires terminal elements not only for the switching mechanism or mechanisms but also for this potentiometer. Consequently, an electrical connection must be provided within the switch between the inner ends of the terminal elements and the potentiometer plate. In accordance with the invention, the potentiometer plate is connected to the terminal elements by slip-in attachment which not only ensures a safe hold but also effects the electrical contact. To this end, the potentiometer plate is inserted into slot-shaped seats of the terminal elements, which are prevented from being unduly enlarged by suitable means. The firm hold is in addition ensured by corresponding grooves provided in the housing, and preferably and in addition, by studs which are provided on the housing cover and which, while securing the cover to the housing, are ultrasonically plasticized, in order to produce exactly fitting holding elements.

12 Claims, 9 Drawing Figures

ELECTRICAL SWITCH

FIELD AND BACKGROUND OF THE INVENTION

The invention relates to an electrical switch comprising at least one switching mechanism and a potentiometer plate with a slider which, particularly, is movable by a member for actuating the switching mechanism, with the potentiometer plate being connected in an electrically conducting manner to terminal elements of the switch. A switch of this kind is known per se and very often employed in electrically operated hand tools, especially percussion drills. The incorporated potentiometer permits setting of quite definite control characteristics of the drive motor. On the other hand, of course, the switch must be of relatively small size, since it might be necessary to accommodate it in the handle or another narrowly limited zone of the hand tool. This calls for a miniaturization of all the component parts, thus also of the potentiometer plate. This plate must be electrically connected to preferably three terminal elements. For constructional reasons, these points of connection are mostly provided deeply inside a narrow switch housing which is closable with a cover. The restricted space conditions on the one hand and the small size on the other hand entail either poor joints, cold junctions, or fouling of the potentiometer with tin and/or flux while effecting the electrical connections by soldering. This results in a relatively high reject rate and increased test cost. In addition, the connecting operation itself is difficult and already for this reason time consuming and expensive.

SUMMARY OF THE INVENTION

The present invention is directed to a structure for an electrical switch of the above mentioned kind, which permits a connection of the potentiometer plate to its terminal elements in a quick and reliable manner largely protecting the plate.

An object of the present invention is to provide an electrical switch which comprises a housing, a movable member movable in the housing, at least one switching means in the housing which is activatable by the movable member, at least one terminal element connected to the housing, a potentiometer plate being slipped onto said terminal element for attachment thereto, and a slider connected to said movable member and engageable with said potiometer plate. What is obtained by providing a slip-on connection is that not only the connections are made exactly at the predetermined points but also the terminal elements are connected to the potentiometer plate quickly and neatly. Since tin and flux or other liquid or similar connecting means are not used, the potentiometer tracks cannot be fouled and poor electrical connections are eliminated. The slip-on connection must be such that the potentiometer plate remains securely fixed in place even under rough operating conditions, for example in an electrically operated hand tool, and, on the other hand, that in spite of the satisfactory clamping force at the junction, the engagement is neither damaging nor too hard to effect. The potentiometer plate is preferably planar, so that the attaching holders are arranged in a row. It is also possible, however, to mount potentiometer plates of other shape reliably and well in the same way. With three terminal elements and a planar plate, the elements are advantageously associated with both ends and the middle of the plate. They in turn are held in place without play in the housing and may for this purpose be inserted, or fixed by injection molding or fastened in another known manner in corresponding slots. They are secured in addition by mounting to the cover or to a second part of the housing.

According to a development of the invention, the inner end portion of each terminal element is given the shape of a U, to form a slot-shaped seat for the potentiometer plate. Upon making the entire terminal element of an electrically conducting material such as sheet brass, an uninterrupted electrical connection from the free end of each of the terminal elements to the potentiometer plate or the electrically conducting track thereof is instantly obtained. The U-shaped seats can resiliently be spread apart, i.e. upon inserting the respective edge of the potentiometer plate, at least one, preferably both, of the U-legs slightly deflect transversely to the plane of the plate. This deflection, of course, is maintained within the elastic range of the material and produces the pressure in the seat area, necessary for a satisfactory electrical contact.

Another development of the invention provides that each of the three U-leg ends of each terminal element is enlarged by a protuberance, with the protuberances facing each other and projecting into the U-slot. These protuberances may be compared to fixed contacts formed thereon and they ensure a punctual electrical contact between the respective terminal element and the contact point provided for this purpose on the potentiometer plate. The prerequisite is, of course, that the necessary tolerances are observed both during the mounting of the terminal elements in the housing and during the manufacture and mounting of the potentiometer plate. These tolerances, however, do not exceed the usual range in such switches. In addition, due to the point contact between the U-legs or the leg effecting the electrical connection, a relatively high unit surface pressure is obtained ensuring a safe and satisfactory electrical connection.

In a modification of the connection, it is provided that each U-leg of a terminal element engages a groove provided in the housing and extending in the longitudinal direction of the leg, with the open sides of the grooves being opposite to each other and one groove bottom being spaced from the other by a distance which slightly exceeds that between the outsides of the two U-legs of the terminal elements. The difference between the outside spacing of the U-legs and the spacing of the two grooves is such that while introducing the potentiometer plate, the two U-legs can deflect outwardly only to an extent ensuring that the bending takes place safely within the elastic range. This prevents the U-legs of the terminal elements from being deflected beyond the elastic range upon an oblique or other not quite correct insertion of the potentiometer plate.

In another embodiment of the invention, it is provided that one of the U-legs of a terminal element engages a housing groove extending in the longitudinal direction of the leg, and that a web or the like extends sidewards of the other U-leg and is provided with a stop projecting against this other leg in the free end zone thereof. This design makes it possible to lead the terminal elements into the housing not in the direction in which the potentiometer plate is introduced, but transversely thereto, so that with the same housing, the switch may also be mounted and connected in a different way. There is no difference in operation, i.e. with this embodiment again, damage by overstraining the U-legs during the mounting of the potentiometer plate are safely prevented. The stop may be formed by a lug etc. formed on, or by a portion of, a web which, to reduce costs of manufacture and assemblage, may be made in one piece with the terminal elements, for example, by stamping.

An advantageous further development of the invention provides that the potentiometer plate engages by one of its longitudinal edges into the terminal elements and by its two transverse edges into two grooves which extend in the housing with their open sides opposite each other, and that the plate corners remote from the terminal elements are fixed in the longitudinal and transverse directions by holding members which are provided, and particularly formed, on the housing cover. The potentiometer plate is held in place well already upon being inserted into a housing. This position is secured in the longitudinal and transverse directions after the cover is firmly connected to the housing. Since the holding members of the cover engage over the potentiometer plate corners close to the cover, the potentiometer plate is held fast in the longitudinal and transverse directions without play, so that the electrical connection with the terminal elements is safely maintained, even upon its exposure to strong vibrations, such as in a percussion drill.

In a switch having an actuating member in the form of a plunger carrying the slider, another development of the invention provides that the plunger is designed with a groove for retaining the slider, which groove extends transversely to the direction of plunger actuation and is bounded by a stop surface at one end. The plunger has an L-shaped or similar cross section to form a backing strip for the slider and the attachment end of the slider is about S-shaped with the free S leg engaging the backing strip from below while the other S-leg blends into the slider arm or arms. The width of the retaining groove is larger than, particularly twice, the thickness of the attachment end of the slider. The slider is introduced into the retaining groove in a position which is turned relative to its operating position, until it applies against the stop surface. Then it is pivoted about so to speak the longitudinal axis of the backing strip, which makes its free S-leg engage this backing strip from below. This brings the slider into its operating position.

Upon applying the slider end, which, particularly, has a U or V-shape cross section, resiliently against the potentiometer plate, both the needed constant pressure and a definite hold in the groove are ensured. This design makes it possible to insert and fasten the slider in the plunger quickly and entirely without problems. It must be kept in mind in this connection that in sliders for such switches, lengths and widths of one millimeter and less are quite usual and that hitherto, these small dimensions made an assemblage very difficult. Since now a substantially wider retaining groove can be used into which, with the correct position of the plunger, the slider is so to speak dropped, the mounting is considerably simplified and, in practice, no risk is run of damaging the slider during assemblage.

Switches of the kind described in the foregoing are certainly precision devices, and, consequently they must be well protected against fouling and moisture. A weak point is usually the passage of the plunger through the housing. To come to an improvement in this regard, it is provided that advantageously, the plunger extends through a sealing sleeve or the like inserted in the housing of the switch. No problems arise with such a seal particularly if the plunger has a circular cross section, at least in the zone of this sealing sleeve.

An advantageous further development of the invention is characterized by two additional terminal elements which are designed as screw terminals or the like and are fastened particularly by slip-on attachment, to the housing end remote from the pushbutton of the plunger. Due to this design, the switch is provided on its wall remote from the pushbutton, for example, with two terminals for the power line, and on another of its walls and/or on the bottom of the housing, with terminals for internal circuits such as for controlling the drive motor of an electrically operated hand tool, which are normally designed as plug-in connections.

With this design, it is a particular advantage if at least one of the screw terminals carries a fixed contact of the switching mechanism, or of one of them, so that while mounting the screw terminal, this fixed contact is mounted at the same time.

To ensure a permanent electrical connection between the potentiometer plate and the terminal elements even under rough operating conditions, the potentiometer plate must be held immovably in its place, as mentioned above. To this effect, an inventive method is provided for a vibration-proof fixing of the potentiometer plate edge portion which is adjacent the housing cover, i.e. remote from the terminal elements, which method is characterized in that a bead or individual drops of an adhesive, sealing material, or the like, are applied to this edge portion and/or the inside of the cover in the zone of this edge portion, and then the cover is firmly connected to the housing. Such beads or drops of another setting material embed the respective edge portion or potentiometer plate corners associated with the cover and eliminate any play. By providing additional measures, such as at least one small element for holding down the cover, the plate may be firmly pressed into the seats of the terminal elements as the cover is secured to the housing, so that after the material has set, no plate displacement is possible.

Another solution of this problem in a method of vibration-proof fixing of the potentiometer plate edge portion adjacent to the cover and remote from the terminal elements is to place the cover loosely on the housing and support it in the zone of the associated plate corners through two plasticizable studs, extensions, or the like, then to heat and thereby plasticize the studs, bring the cover subsequently or simultaneously into its final position while pressing the plasticized studs etc. against their plate corner, thereby forming them to fitting holding elements, and finally to cool the heated parts. Upon cooling, the parts solidify and form exactly fitting retaining elements which hold the plates fast in the longitudinal and transverse directions and also press them without play into the seats of the terminal elements. It is advisable in this connection to rivet the cover to the housing and thus to secure the permanent hold. In spite of its small dimensions, the potentiometer plate is satisfactorily resistant to bending, so that basically, additional holding members, particularly plasticizable studs on the cover, are not needed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 4:
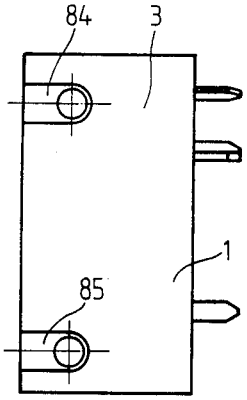
FIG. 4 is a view of the switch of FIG. 1 taken in the direction of arrow A.
Figure 1:
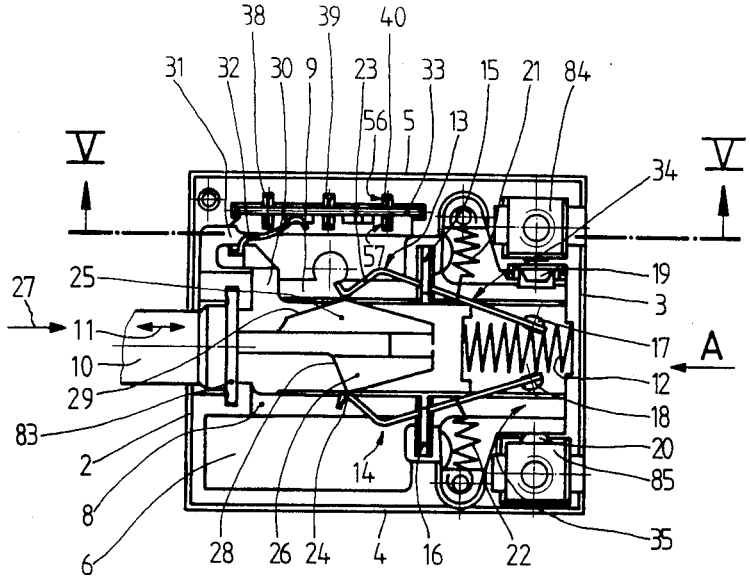
FIGS. 1 to 3 are top plan views of three different embodiments of the invention, with the housing cover removed.
Figure 5:
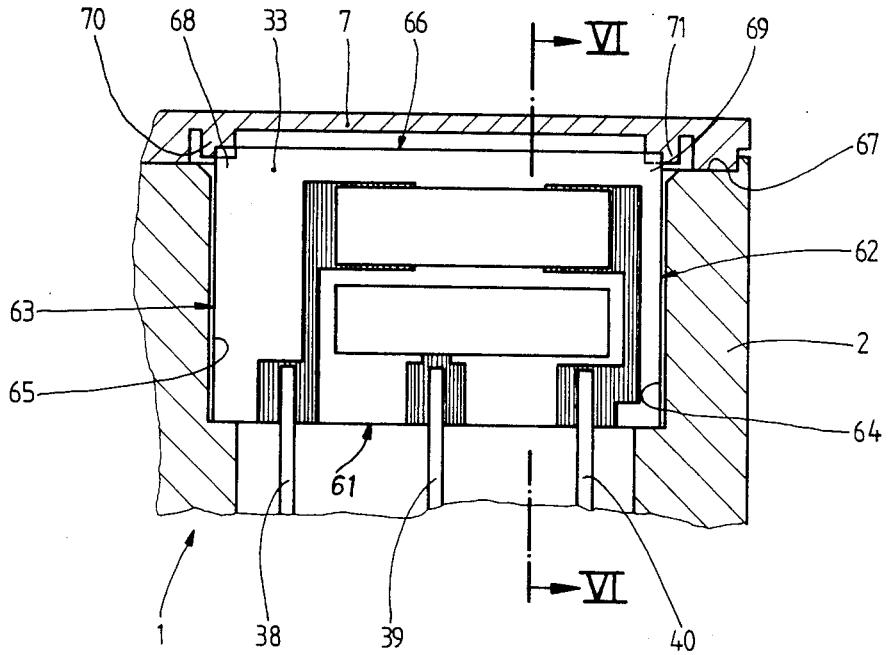
FIG. 5 is an enlarged partial sectional view taken along the line V—V of FIG. 1; and with the housing cover.

The switch according to the invention, and as shown in FIGS. 1 and 4, comprises a preferably rectangular housing 1 having four sides walls 2,3,4,5 and a bottom 6, and closable with a cover 7 (FIG. 5). In a guideway 8,9, a plunger a movable member 10 is displaceable linearly in a direction of double arrow 11 against the action of the return spring 12. The return spring is embodied by a helical compression spring. In the embodiment of FIG. 1, two contact arms 13 and 14 are mounted for tilting on knife-edge supports 15,16. They each carry a movable contact 17,18 cooperating with a fixed contact 19,20. Each of the lever arms carrying the movable contact is loaded by a spring 21,22 embodied as a helical tension spring. The respective other lever arm has a hook-like end portion 23,24 by which it applies against a cam 25,26 of the inner end of the plunger. Upon pushing plunger 10 in the direction of arrow 27, the hook-like end portion 24 of contact arm 14 slides along the steep flank 28 of cam 26, which leads to an abrupt closing of contacts 18,20. Flank 29 of the other cam 25, on the contrary, is flatter so that movable contact 17 approaches its fixed contact substantially slower.

A lateral extension 30 of plunger 10 carries a support 31 for a slider 32. The slider cooperates with a potentiometer plate 33. Consequently, upon pressing plunger 10, not only the two switching mechanisms 34 and 35 are actuated, but also the potentiometer 32,33 is operated or picked off. In the first embodiment, the design is such, as already explained above, that initially contacts 18,20 are closed, simultaneously and subsequently the potentiometer is picked off along its entire length, and at the end of the displacement of plunger 10, contacts 17 and 19 are closed. In addition, a small overtravel may be provided terminating as soon as the inner end of plunger 10 abuts against the inside of side wall 3.

In the two other embodiments (FIGS. 2 and 3), a single switching mechanism 36,37 is provided by which the contacts are closed at the start of the potentiometer pick-off. Other designs of switching mechanisms may also be provided, of course, having contacts which are closed or opened depending on the purpose of the switch.

Figure 2:
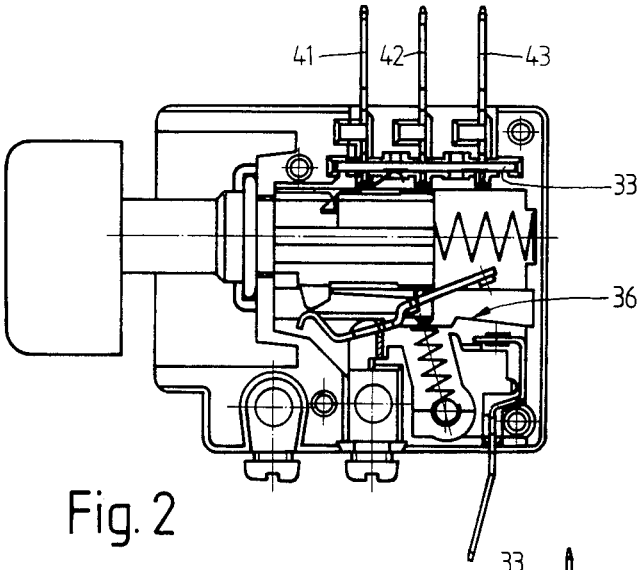
Figure 3:
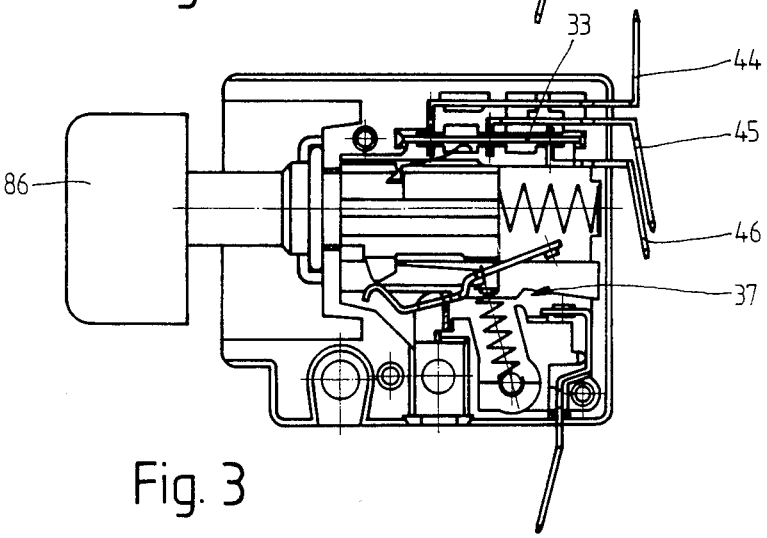

The potentiometer plate 33 which, preferably, is planar and rectangular, is inserted into the terminal elements 38,39,40 perpendicularly to the drawing plane whereby it becomes electrically connected. Plate 33 extends in the direction of motion of plunger 10. The mechanical and electrical connection of potentiometer plates 33 to terminal elements 41 to 43 and 44 to 46 of the switches according to FIGS. 2 and 3 is effected in a similar way. Depending on the design, the terminal elements are passed through the side walls or the bottom 6 of the housing to the outside where they may take the form of plug connections, solder lugs or the like, for an electrical conductor.

Figure 6:
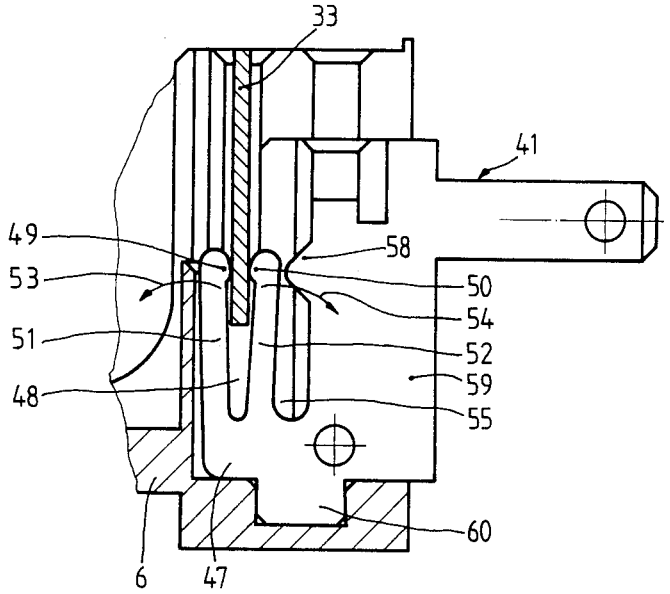
FIG. 6 is a partial view taken along the line VI—VI of FIG. 5.

FIGS. 5 and 6 show this connection of a potentiometer plate 33 to its (preferably three) terminal elements particularly clearly. The holders or slot-like seats 48 for firmly clamping potentiometer plate 33 while establishing an electrical connection to terminal elements 38 to 46 at the same time, are formed by the inner, U-shaped end portions 47 of the respective terminal elements. The free U-leg ends of each terminal element 38 to 46 are enlarged by protrusions 49,50 which, as shown in FIG. 6, project against each other into the slot-shaped seat. The effect thereby obtained is not only a punctiform electrical contact with the electrical part of the potentiometer plate but also a high unit surface pressure and thus a strong holding force. This force results solely from the resilience of U-legs 51,52 in the direction of arrows 53,54. Depending on the design of the housing space 55 for receiving the U-shaped end portion 47, the resilient deflection may be reduced to only one of the two legs. According to FIG. 1, each U-leg of terminal elements 38,39,40 engages a groove 56,57 extending in the housing in the longitudinal direction of the leg, thus perpendicularly to the drawing plane of FIG. 1. The groove bottom of one groove 56 is spaced from the bottom of the other groove 57 of the housing by a distance which only slightly exceeds that between the outsides of the two U-shaped legs 51,52, prior to inserting potentiometer plate 33. Therefore, while inserting the potentiometer plate, the U-legs are permitted to bend only to the extent of the elastic deflection determined by this difference, and overstraining, i.e. a plastic deformation or other permanent damage to the U-legs or to seat 48, is thus prevented.

In the design of FIG. 6, only one of U-legs 51 engages such a groove 57 in the housing, so that the elastic deflection of the other U-legs 52 is limited differently. A stop 58 is provided to this end on the intermediate portion 59 of terminal elements 41–46, permitting the terminal elements to extend sidewards from the housing, as may be learned from FIGS. 2 and 3. FIG. 6 further shows that a lug 60 of the terminal element engages the correspondingly shaped recess in the housing bottom, thereby exactly locating the terminal element. FIG. 5 shows that the lower longitudinal edge 61 of the plate is held in place by terminal elements 38 to 46, while the two transverse edges 64,65 engage two oppositely open grooves 64,65 of the housing where they secure a hold of the plate. The upper longitudinal edge 66 slightly projects beyond the supporting surface 67 of cover 7. The two corners 68,69 of the plate are associated each with a stub 70,71 of cover 7. The cover and the housing are made of plastic. If the cover after being loosely placed on the housing is heated, particularly by ultrasonic waves, in the zone of stubs 70,71, the material of the stubs softens, wherefore, upon engaging cover 7 fully on supporting surface 67, the corners 68 and 69 of potentiometer plate 33 get impressed into the plasticized stubs. Upon removing the heat, the stubs solidify and hold the two corners fast, without play. In this way, the potentiometer plate becomes arrested, in a manner which is especially resistant to vibrations, within the switch housing, whereby, of course, the electrical connections between the potentiometer plate and the terminal elements 38 to 46 are made permanently safe, even under rough operating conditions in a percussion drill.

Figure 7:
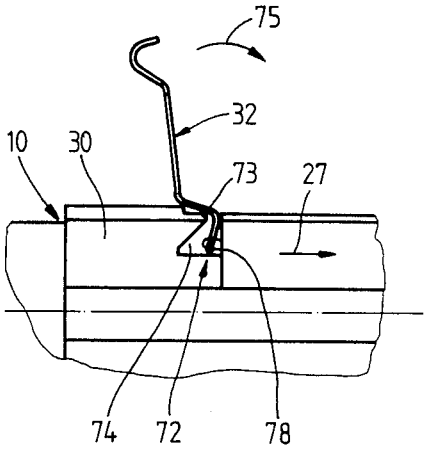
FIG. 7 is an enlarged detail of FIG. 1 showing the region of the slider with the slider in its mounting position.
Figure 8:
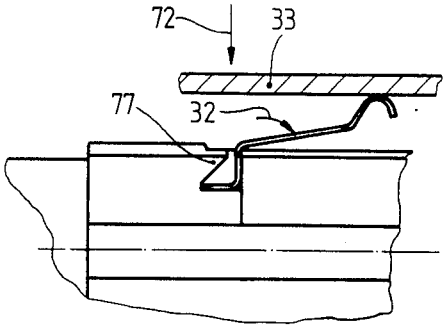
FIG. 8 is a view similar to FIG. 7, with the slider in its operating position.
Figure 9:
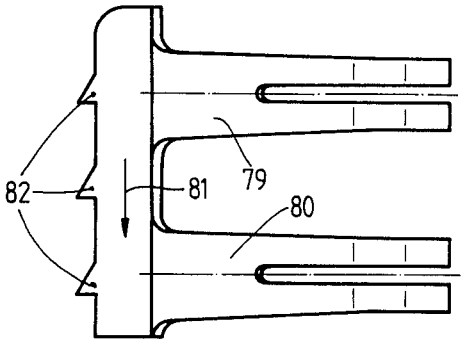
FIG. 9 is a further enlarged top plan view of the slider according to FIGS. 7 and 8.

Plunger 10, or its lateral extension 30, is provided with a retaining groove 72 for slider 32, which groove extends transversely to the direction of actuation 27 of the plunger, thus in the direction of the width of the slider. Upon inserting slider 32 into groove 72, for example, from above downwardly, perpendicularly to the drawing plane (FIG. 7), the longitudinal edge remote from the observer, of slider 32, or of the attachment end 73 of the slider, come to apply against a stop surface 74. During this insertion, the slider occupies a position shown in FIG. 7, for example. Thereupon, the slider is pivoted in the direction of arrow 75, so that it finally occupies its operating position shown in FIG. 8. Instead of inserting the attachment end 73 of slider 32, which end is preferably S-shaped, perpendicularly to the drawing plane, it may also be inserted into retaining groove 72, which has an L-shape or about triangular cross section, in the direction of arrow 76. This cross section of groove 72 forms a backing strip 77 which, in the operating position, is engaged by the free S-leg of slider 32 from below. The mid portion of the S preferably applies against wall 78 of the groove. The other S-leg blends into the slider arm or, according to the embodiment of FIG. 9, slider arms 79,80 which, preferably, are forked, in addition. The easy insertion of slider 32 in either of the two directions is made possible by the provision that the width of the retaining groove in the zone of the free end of triangular backing strip 77 exceeds, particularly about twice, the thickness of the slider or of the attachment end portion 73 of the slider, which may particularly well be seen in FIG. 8. A displacement in the direction of arrow 81, i.e. away from the stub surface 77, may advantageously be prevented by barbs 82 formed on the slider. The barbs may penetrates into the body of plunger 10 made of plastic. Further, plunger 10 is sealed at the location where it passes through the housing or housing wall 2 to the outside by means of a sealing sleeve 83 which is anchored in the switch housing. At least at this location, the cross section of the plunger is circular.

As already explained, the inventive switch may be provided with terminal elements 38 to 46 of most various design, without departing from the basic invention. If an electrically operated hand tool is concerned, these terminal elements primarily serve the purpose of connecting electrical lines for internal circuits. For this reason, the externally located free ends are mostly designed as plug connections. Screw connections are required by regulations for the power line. For this reason, screw terminals 84 and 85 are inserted, from above downwardly, perpendicularly to the drawing plane (FIG. 1), in two corresponding recesses of housing 1. Preferably they are located at the switch side remote from the pushbutton 86 of plunger 10, i.e. in the zone of side wall 3 of the switch. This makes both the assemblage and the power line connection easier. According to FIG. 1, fixed contact 20 is provided directly on screw terminal 85.

While specific embodiments of the invention have been shown and described in detail to illustrate the application of the principles of the invention, it will be understood that the invention may be embodied otherwise without departing from such principles.

We claim:

1. A switch comprising an actuating member designed as a plunger and carrying a slider, characterized in that the plunger (10) is provided with a retaining groove (72) for the slider (32), extending transversely to a direction (27) of the plunger actuation and bounded at one end by a stop surface (74) and having an L-shaped a cross section to form a strip (77) for backing the slider (32), and that an attachment end portion (73) of the slider (32) is approximately S-shaped, with a free S-leg engaging the backing strip (77) from below while a S-leg blends into slider arms (79,80), and with the web of the retaining groove (72) being larger than the thickness of the attachment end (73) of the slider.

2. A switch according to claim 1, characterized in that the plunger (10) extends through a packing ring (83) inserted in the switch housing (1).

3. A switch according to claims 1 or 8, characterized by two additional terminal elements which are designed as screw terminals (84,85) and are fastened, by slip-on attachment, to a housing end remote from the pushbutton of the plunger.

4. A switch according to claim 3, characterized in that at least one of the screw terminals (84,85) carries a fixed contact (20) of a switching mechanism (34 to 37);

5. An electrical switch comprising:

a housing;

a plunger linearly movable in said housing in a selected direction;

at least one switching means in said housing which is activatable by said plunger to close said at least one switching means;

a plurality of terminal elements fixed to said housing and spaced from each in said selected direction, each element having a part accessible from an exterior of said housing for connection;

a planar potentiometer plate in slip-on attachment to each terminal element and extending in said selected direction in said housing; and a slider connected to said plunger and engageable with said potentiometer plate;

each terminal element including an end portion in said housing defining a slot seat into which said potentiometer plate is slid to form said slip-on attachment, said end portion having at least one resiliently movable leg bounding said slot seat and resiliently engaged against said planar potentiometer plate for holding said plate in said slot seat and in said housing.

6. An electrical switch according to claim 5, wherein each terminal element is flat and extends in a direction transverse to said selected direction, each terminal element having a U-shaped end portion including said at least one resiliently movable leg and a second resiliently movable leg defining said slot seat, each leg having an enlarged protruberance extending into said slot seat and resiliently engaging said potentiometer plate.

7. An electrical switch according to claim 6, wherein said housing includes a potentiometer plate receiving slot, said plate being rectangular and having opposite longitudinal edges extending parallel to said selected direction and opposite transverse edges extending transverse to said selected direction, one of said longitudinal axes engaging with each terminal element, said transverse edges being adjacent opposite sides of said potentiometer plate receiving slot, a cover connected to said housing and engaged over said potentiometer plate receiving slot, and opposite one of said longitudinal edges engaging with said cover for fixing said potentiometer plate in said housing, said housing including a groove for receiving each of said terminal elements with each groove extending transverse to said selected direction.

8. An electrical switch according to claim 7, wherein said plunger includes a groove having a substantially L-shaped cross section with a web opening and a strip extending over said groove, said slider having an end portion with an S-shape, an outer leg of said S-shaped end portion engaged under said strip and an inner leg of said S-shaped end portion extending out of said groove, said groove web having a width which is larger than a thickness of said slider end portion.

9. An electrical switch according to claim 8, wherein said groove web is about twice said slide end portion thickness.

10. An electrical switch according to claim 8, wherein said at least one switch means comprises a screw terminal fastened by slip-on attachement to said housing at an end of said housing remote from said plunger, said screw terminal carrying a fixed contact of said switching means, said switch means further including a movable contact pivotally mounted in said housing having one end engageable with said fixed contact and another end engageable by said plunger for moving said movable contact into and out of engagement with said fixed contact with movement of said plunger in said selected direction.

11. An electrical switch according to claim 6, wherein said housing includes a groove extending in a longitudinal direction of said legs, said legs extending into said groove, said groove having a width and length slightly greater than a width and length of said legs.

12. An electrical switch according to claim 6, wherein said terminal element includes an intermediate portion connected to said end portion and having a stop engageable against a side of one of said legs opposite said slot seat and adjacent an outer free end of said one of said legs.

* * * * *